US007069822B1

(12) United States Patent
Mathis

(10) Patent No.: US 7,069,822 B1
(45) Date of Patent: Jul. 4, 2006

(54) MOVABLE WRENCH HANDLE ASSEMBLY

(76) Inventor: Kevin Mathis, 17 Marigold LN, Willingboro, NJ (US) 08046

( * ) Notice: Subject to any disclaimer, the term of this patent is extended or adjusted under 35 U.S.C. 154(b) by 128 days.

(21) Appl. No.: 10/782,115

(22) Filed: Feb. 19, 2004

(51) Int. Cl.
*B25B 23/16* (2006.01)
*B25G 1/00* (2006.01)

(52) U.S. Cl. ..... 81/177.1; 81/176.1; 81/176.15

(58) Field of Classification Search ..... 81/177.1, 81/176.1, 176.15, 177.8, 125.1, 124.5
See application file for complete search history.

(56) References Cited

U.S. PATENT DOCUMENTS 3,282,136 A 11/1966 Maichen
4,151,763 A 5/1979 Colvin
4,327,611 A * 5/1982 Catanese et al. ..... 81/177.9
4,593,585 A 6/1986 Hurtig
5,018,411 A * 5/1991 La Padura ..... 81/57.5
6,092,442 A * 7/2000 Macor ..... 81/180.1
6,378,400 B1 4/2002 Bogli
6,523,440 B1 * 2/2003 Friedman et al. ..... 81/125.1
6,784,799 B1 * 8/2004 Hsien ..... 340/668
2003/0167884 A1 * 9/2003 Macor ..... 81/177.1

* cited by examiner

*Primary Examiner*—Lee D. Wilson
*Assistant Examiner*—Alvin J Grant

(57) ABSTRACT

A movable wrench handle assembly for facilitating comfortable grasping of a wrench while minimizing interference of the comfortable handle structure with the opposing end couplers of the wrench includes a wrench having a pair of end portions and a medial portion extending between the end portions. A handle member is coupled to the wrench such that the handle member is slidable along the medial portion. A locking assembly holds the handle member in place during use.

19 Claims, 3 Drawing Sheets

38
24
10
14
24
36
18
32
36
42
42
24
40
26
22
20
16

MOVABLE WRENCH HANDLE ASSEMBLY

BACKGROUND OF THE INVENTION

1. Field of the Invention

The present invention relates to hand tools and more particularly pertains to a new movable wrench handle assembly for facilitating comfortable grasping of a wrench while minimizing interference of the comfortable handle structure with the opposing end couplers of the wrench.

2. Description of the Prior Art

The use of hand tools is known in the prior art. U.S. Pat. No. 3,282,136 describes an adjustable wrench having adjustable head portions. Another type, of hand tool is U.S. Pat. No. 4,151,763 disclosing an adjustable wrench having a longitudinal adjustment structure extending through the handle. U.S. Pat. No. 4,593,585 discloses an adjustable wrench having pivoting ends and a longitudinal depression along the handle. U.S. Pat. No. 6,378,400 discloses a detachable handle socket ratchet wrench system.

While these devices fulfill their respective, particular objectives and requirements, they all include the common fault of providing a relatively thin handle for gripping as it is desirable to have relatively thin end portions to facilitate engagement of the end portions to nuts and the like, particularly in tight spaces. The need remains for a wrench that provides a comfortable gripping portion or handle that can be moved along a length of a wrench to inhibit interference between the handle and a work piece during use.

SUMMARY OF THE INVENTION

The present invention generally comprises a wrench having a pair of end portions and a medial portion extending between the end portions. A handle member is coupled to the wrench such that the handle member is slidable along the medial portion. A locking assembly holds the handle member in place during use.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
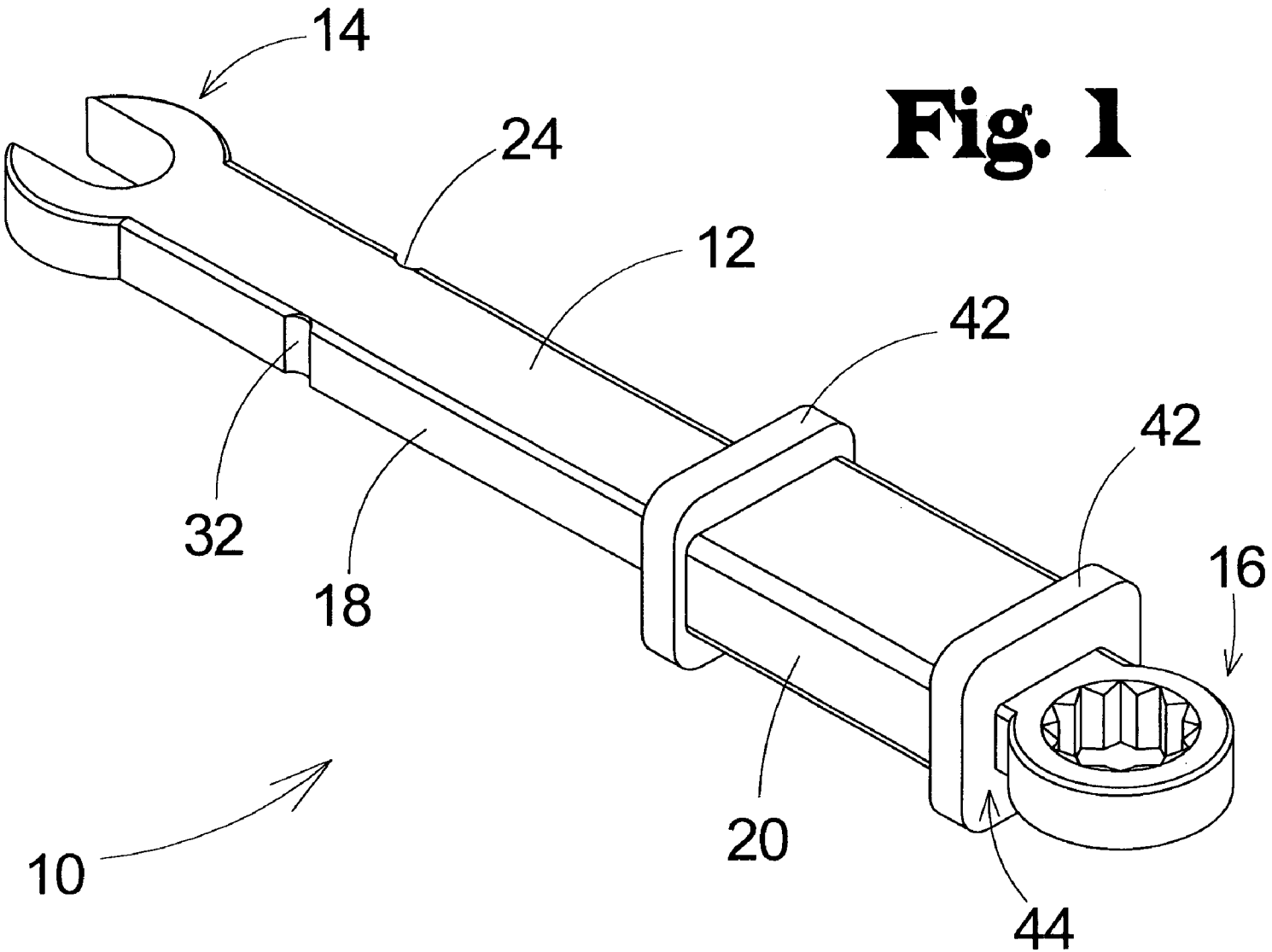
FIG. 1 is a perspective view of a new movable wrench handle assembly according to the present invention.
Figure 2:
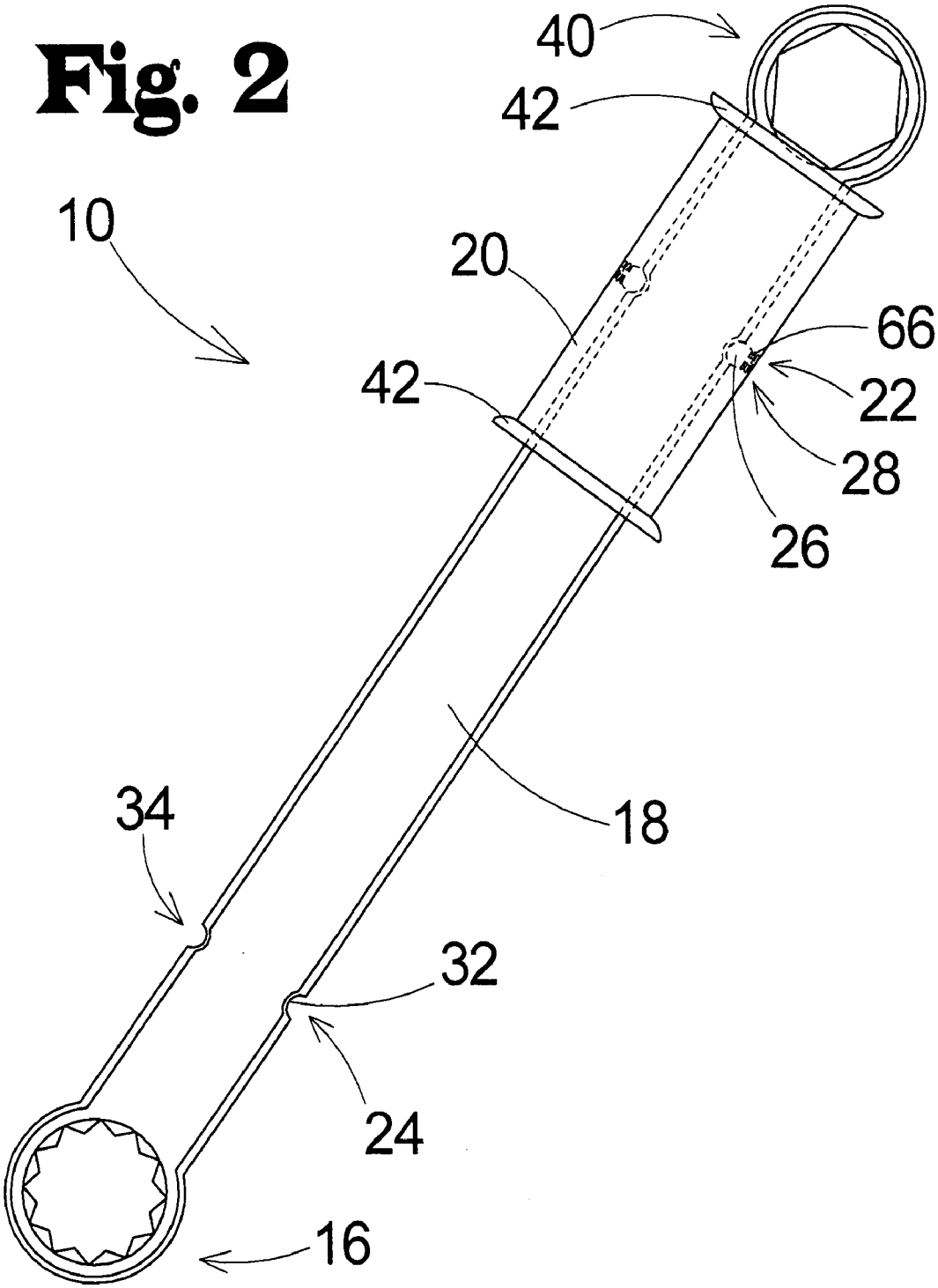
FIG. 2 is a partial cut-away top view of an embodiment of the present invention.
Figure 3:
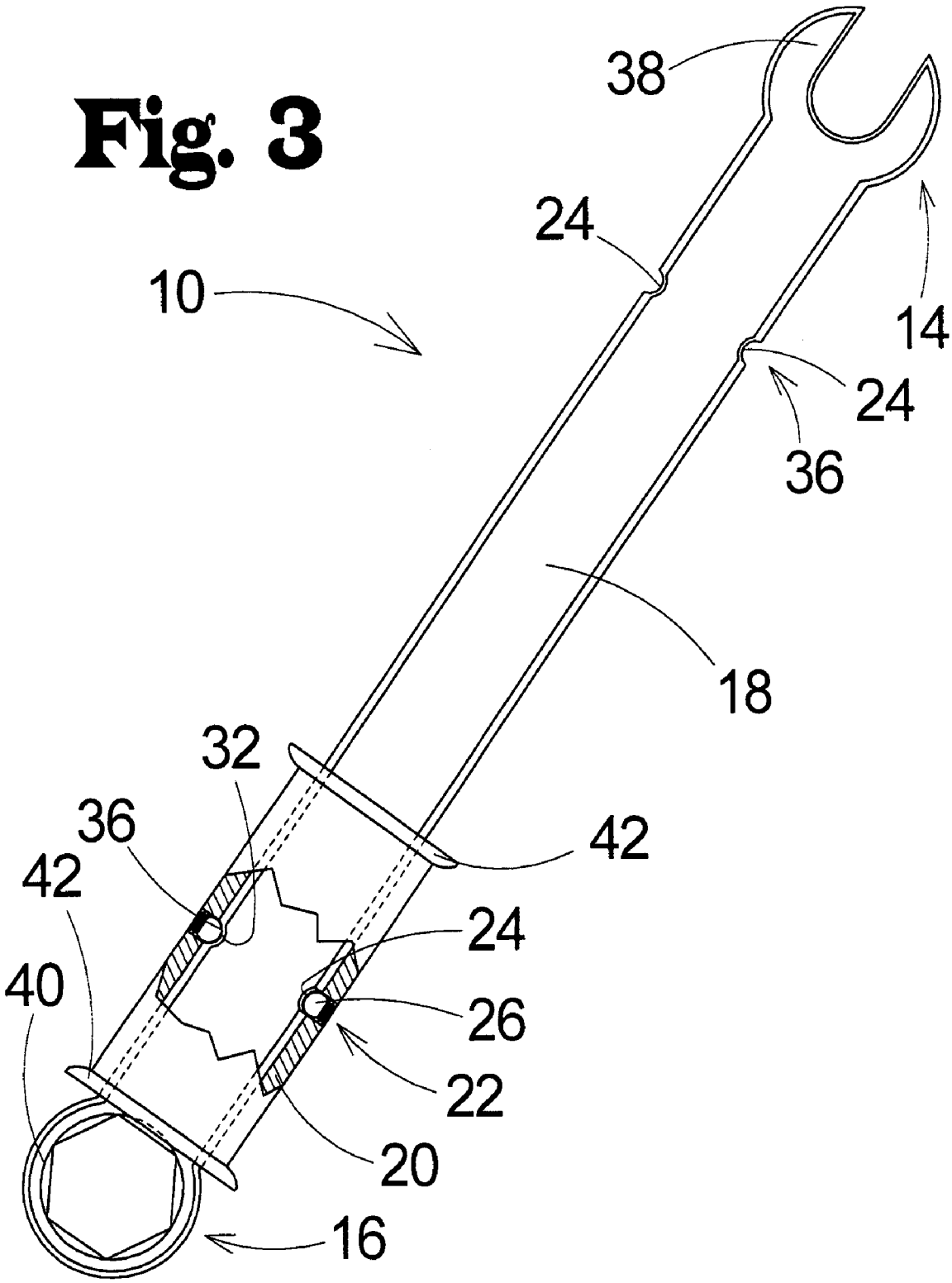
FIG. 3 is partial cut-away top view of an embodiment of the present invention.

With reference now to the drawings, and in particular to FIGS. 1 through 3 thereof, a new movable wrench handle assembly embodying the principles and concepts of the present invention and generally designated by the reference numeral 10 will be described.

As best illustrated in FIGS. 1 through 3, the movable wrench handle assembly 10 generally comprises a wrench 12 that has a pair of end portions 14,16 and a medial portion 18 extending between the end portions 14,16. A handle member 20 is coupled to the wrench 12 such that the handle member 20 is slidable along the medial portion 18. Locking means 22 are provided for holding the handle member 20 in a position adjacent to a selectable one of the end portions 14,16 of the wrench 12.

The locking means 22 is most preferably formed by a plurality of indentations 24 in the medial portion 18 of the wrench 12 and at least one locking member 26 extendably coupled to the handle member 20. Minimally, a pair of indentations 24 are provided with one being positioned at each end of the medial portion of the wrench 12. Biasing means 28 such as springs 66 are provided for urging the locking member 26 outwardly from the handle member 20 such that the locking member 26 engages a selectable one of the indentations 24 to hold the handle member 20 adjacent to a selected one of the end portions 14,16.

In an embodiment, the locking member 26 has a convex surface 36 for abutting a complimentary surface 32 of a selected indentation 24. Thus, the locking member 26 is slidable along the medial portion 18 as the handle member 20 is moved by application of lateral force in excess of a threshold frictional force between the locking member 26 and the selected indentation 24.

Most preferably, the indentations 24 are arranged into oppositional indentation pairs 34,36. Each oppositional indentation pair 34,36 is positioned adjacent to an associated one of the end portions 14,16. Correspondingly, a pair of locking members 26 are extendably coupled to the handle member 20. The locking members 26 are oppositionally positioned for engaging a selectable oppositional indentation pair 34,36.

Preferably, end portion 14 forms an open-ended wrench coupler 38 and end portion 16 forms a box-ended wrench coupler 40. Typically, each end portion is sized similarly. Alternately, as shown in FIG. 2, both end portions may be closed but each end portion providing a unique interior shape. As shown in FIG. 2, a six point box end is provided opposite a twelve point box end.

The handle member 20 has a pair of raised end lips 42 such that the handle member 20 is designed for inhibiting slipping of a hand grasping the handle member 20.

The medial portion 18 of the wrench 12 has a non-circular cross-section, most preferably rectangular for comfort and ease of manufacture. The handle member 20 includes a bore 44 extending therethrough for receiving the medial portion 18. The bore 44 has a non-circular cross-section complimentary in shape to the cross-section of the medial portion 18 for inhibiting rotation of the handle member 20 around the medial portion 18 during use.

In use, the handle member is positioned by the user adjacent to the end portion opposite the end portion the user desires to use. The wrench is then used in conventional fashion.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A movable wrench handle assembly comprising:

a wrench having a pair of end portions and a medial portion extending between said end portions;

a handle member coupled to said wrench such that said handle member is slidable along said medial portion;

locking means for holding said handle member in a position adjacent to a selectable one of said end portions of said wrench;

wherein said locking means comprises:

a plurality of indentations in said medial portion of said wrench;

a locking member extendably coupled to said handle member; and biasing means for urging said locking member outwardly from said handle member such that said locking member engages a selectable one of said indentations for holding said handle member adjacent to a selected one of said end portions.

2. The movable wrench handle assembly of claim 1 wherein said locking member has a convex surface for abutting a complimentary surface of a selected indentation whereby said locking member is slidable along said medial portion of said wrench upon application of lateral force in excess of a threshold frictional force between said locking member and said selected indentation.

3. The movable wrench handle assembly of claim 1 wherein one of said end portions forms an open-ended wrench coupler.

4. The movable wrench handle assembly of claim 1 wherein one of said end portions forms a box-ended wrench coupler.

5. The movable wrench handle assembly of claim 1 wherein a first one of said end portions forms an open-ended wrench coupler and a second one of said end portions forms a box-ended wrench coupler.

6. The movable wrench handle assembly of claim 1 wherein said handle member further comprises:

a pair of raised end lips such that said handle member is adapted for inhibiting slipping of a hand grasping said handle member.

7. The movable wrench handle assembly of claim 1 wherein said medial portion of said wrench has a non-circular cross-section; and wherein said handle member includes a bore extending therethrough for receiving said medial portion, said bore having a complimentary non-circular cross-section for inhibiting rotation of said handle member around said medial portion during use.

8. The movable wrench handle assembly of claim 7 wherein said non-circular cross section of said medial portion is rectangular.

9. The movable wrench handle assembly of claim 1 wherein said biasing means is a spring.

10. A movable wrench handle assembly comprising:

a wrench having a pair of end portions and a medial portion extending between said end portions;

a handle member coupled to said wrench such that said handle member is slidable along said medial portion;

locking means for holding said handle member in a position adjacent to a selectable one of said end portions of said wrench;

wherein said locking means comprises:

a plurality of indentations in said medial portion of said wrench, said indentations being arranged into oppositional indentation pairs, each oppositional indentation pair being positioned adjacent to an associated one of said end portions;

a pair of locking members, each locking member being extendably coupled to said handle member, said locking members being oppositionally positioned for engaging a selectable oppositional indentation pair; and biasing means for urging each said locking member outwardly from said handle member such that said pair of locking members engage a selectable one of said oppositional indentation pairs for holding said handle member adjacent to a selected one of said end portions.

11. A movable wrench handle assembly comprising:

a wrench having a pair of end portions and a medial portion extending between said end portions;

a handle member coupled to said wrench such that said handle member is slidable along said medial portion;

a locking assembly configured to hold said handle member in a position adjacent to a selectable one of said end portions of said wrench;

wherein said locking assembly comprises:

a plurality of indentations in said medial portion of said wrench;

a locking member extendably coupled to said handle member; and a biasing assembly configured to urge said locking member outwardly from said handle member such that said locking member engages a selectable one of said indentations for holding said handle member adjacent to a selected one of said end portions.

12. The movable wrench handle assembly of claim 11 wherein said locking member has a convex surface for abutting a complimentary surface of a selected indentation whereby said locking member is slidable along said medial portion of said wrench upon application of lateral force in excess of a threshold frictional force between said locking member and said selected indentation.

13. The movable wrench handle assembly of claim 11 wherein one of said end portions forms an open-ended wrench coupler.

14. The movable wrench handle assembly of claim 11 wherein one of said end portions forms a box-ended wrench coupler.

15. The movable wrench handle assembly of claim 11 wherein a first one of said end portions forms an open-ended wrench coupler and a second one of said end portions forms a box-ended wrench coupler.

16. The movable wrench handle assembly of claim 11 wherein said handle member further comprises a pair of raised end lips such that said handle member is adapted for inhibiting slipping of a hand grasping said handle member.

17. The movable wrench handle assembly of claim 11 wherein said medial portion of said wrench has a non-circular cross-section; and wherein said handle member includes a bore extending therethrough for receiving said medial portion, said bore having a complimentary non-circular cross-section for inhibiting rotation of said handle member around said medial portion during use.

18. The movable wrench handle assembly of claim 17 wherein said non-circular cross section of said medial portion is rectangular.

19. The movable wrench handle assembly of claim 11 wherein said biasing assembly is a spring.

* * * * *